US009565951B2

(12) United States Patent
Schaarschmidt

(10) Patent No.: US 9,565,951 B2
(45) Date of Patent: Feb. 14, 2017

(54) SMALL CHILD AND BABY CARRIER AND EXTENSION ELEMENT FOR THE USE AS A PART OF A SMALL CHILD AND BABY CARRIER

(71) Applicant: Lewon Schaarschmidt, Midlevels (HK)

(72) Inventor: Lewon Schaarschmidt, Midlevels (HK)

( * ) Notice: Subject to any disclaimer, the term of this patent is extended or adjusted under 35 U.S.C. 154(b) by 0 days.

(21) Appl. No.: 14/459,788

(22) Filed: Aug. 14, 2014

(65) Prior Publication Data

US 2015/0136817 A1 May 21, 2015

(30) Foreign Application Priority Data

Nov. 15, 2013 (DE) ..... 20 2013 010 298 U

(51) Int. Cl.
*A47D 13/02* (2006.01)

(52) U.S. Cl.
CPC ..... *A47D 13/025* (2013.01)

(58) Field of Classification Search
USPC ..... 224/158–161
See application file for complete search history.

(56) References Cited

U.S. PATENT DOCUMENTS

| | | | | |
|---|---|---|---|---|
| 5,205,450 | A | 4/1993 | Derosier | |
| 6,257,468 | B1 * | 7/2001 | Yamazoe | A47D 13/025 224/158 |
| 7,766,199 | B1 | 8/2010 | Caperon | |
| 8,636,181 | B2 | 1/2014 | Gunter et al. | |
| 2005/0045674 | A1 * | 3/2005 | Rehbein | A47D 13/025 224/160 |
| 2010/0147910 | A1 | 6/2010 | Schachtner | |
| 2010/0308088 | A1 | 12/2010 | Lindblom | |
| 2014/0097215 | A1 * | 4/2014 | Caperon | 224/160 |

FOREIGN PATENT DOCUMENTS

| | | | |
|---|---|---|---|
| DE | 20 2007 006 204 | U1 | 10/2008 |
| DE | 202008013895 | U1 | 2/2009 |
| DE | 202008015976 | U1 | 3/2009 |
| DE | 202011103052 | U1 | 8/2011 |
| DE | 20 2008 012 126 | U1 | 8/2012 |
| DE | 20 2012 104 318 | U1 | 3/2013 |

(Continued)

OTHER PUBLICATIONS

Extended European Search Report dated (No. 14002401.9) Feb. 27, 2015.

(Continued)

*Primary Examiner* — Corey Skurdal
(74) *Attorney, Agent, or Firm* — Rabin & Berdo, P.C.

(57) ABSTRACT

Described is a small child and baby carrier, that has a waist strap, a carry bag that extends from a lower end which is connected to the waist strap to an upper end region and has a bottom section adjacent to the lower end, as well as an upper body section extending upward from the lower bottom section. Two shoulder straps extend from the upper end region of the carry bag. So that the small child and baby carrier can be used over a longer age and/or size interval of the child, the small child and baby carrier is furthermore provided with an extension element, arranged detachably between the two shoulder straps in the upper end region of the carry bag and designed to extend the upper body section when in use.

20 Claims, 3 Drawing Sheets

(56) References Cited

FOREIGN PATENT DOCUMENTS

Figure 1:
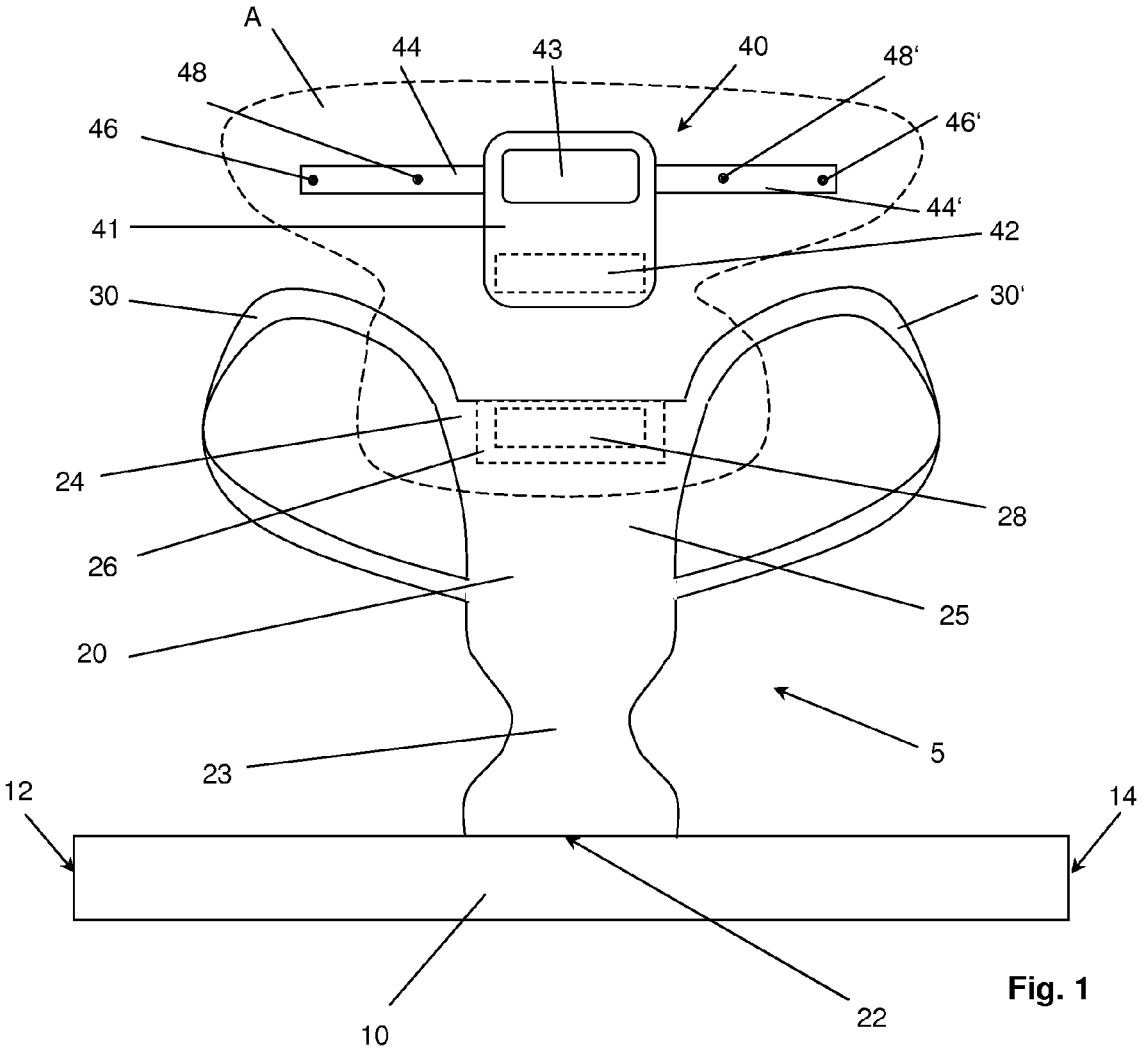

| | | | |
|---|---|---|---|
| EP | 2 491 825 | A2 | 8/2012 |
| JP | 3114676 | U | 10/2005 |
| JP | 2012-187352 | A | 10/2012 |
| KR | 10-2009-0131101 | A | 12/2009 |
| KR | 20-2009-0012560 | U | 12/2009 |
| KR | 20-2010-0002191 | U | 3/2010 |
| WO | WO 2013-037514 | A1 | 3/2013 |

OTHER PUBLICATIONS

Extended European Search Report dated (No. 14002399.5) Mar. 18, 2015.
Extended European Search Report dated (No. 14002400.1) Mar. 18, 2015.

* cited by examiner

SMALL CHILD AND BABY CARRIER AND EXTENSION ELEMENT FOR THE USE AS A PART OF A SMALL CHILD AND BABY CARRIER

The invention relates to a small child and baby carrier as defined in the preamble to claim 1, as well as to an extension element for use as component of such a small child and baby carrier according to claim 13.

Small child and baby carriers have long been known and consist essentially of a waist strap, a carry bag connected to the waist strap, and at least two shoulder straps by means of which the upper end region of the carry bag is connected or can be connected to a lower/middle region of the carry bag or to the waist strap. When in use, the waist strap extends around the waist of the carrying person and the small child or baby sits inside the carry bag, wherein the child's bottom comes in contact with a bottom section of the carry bag and the child's back rests against an upper body section of the carry bag. In this case, the bottom section and the upper body section of the carry bag must be understood to be functional, wherein these two sections generally transition without physical boundary into each other.

When carrying a baby who cannot yet hold up his/her head, the upper body section must extend to the height of the baby's head—if possible somewhat higher—so that the baby's head is supported. Even if the small child to be carried is already big or old enough to hold up the head, it is preferable if the upper body section extends to the height of the head or beyond, so that the head is supported in the event that the child falls asleep (which of course happens frequently).

It follows from the above explanations that a baby carrier as used so far can be used only for a very small size interval (and thus also age interval) since the small child and baby carrier cannot be too large for a small baby.

Based thereon, it is the object of the present invention to further develop a small child and baby carrier in such a way that it can be used for a longer age and/or size interval of the child.

This object is solved with a small child and baby carrier having the features as disclosed in claim 1.

According to the invention, an extension element is provided which is arranged. detachably on the upper end region of the carry bag, between the two shoulder straps, and which extends the upper body section in upward direction when in use. The small child and baby carrier according to the invention thus consists of at least two parts, namely a main element which corresponds to the small child and baby carrier in use so far and an extension element that can be arranged on the main element and extends the upper body section of the main element as needed.

A small child and baby carrier is thus made available which can be dimensioned (and as a rule is dimensioned) such that it is suitable for very small babies in a first state, namely when the extension element is not arranged on the upper body section and which is also suitable for somewhat bigger children in a second state, namely when then extension element is arranged on the upper body section. Thus, only a single small child and baby carrier is needed fur an age interval which so far would have required two small child and baby carriers of different sizes. As compared to the presently used carriers for small children and babies, this single small child and baby carrier comprises a very simple and cost-effective additional part, namely the extension element.

An extension element for use as component of such a small child and baby carrier is disclosed in claim 13.

Preferred embodiments of the invention follow from the dependent claims, as well as from the example explained further with reference to the Figures.

Figure 3:
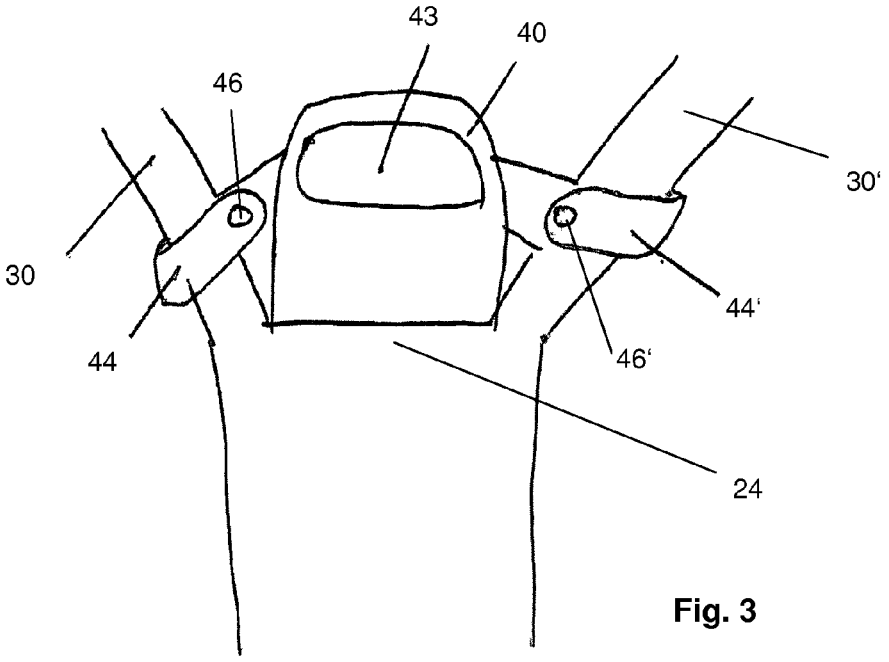
Figure 2:
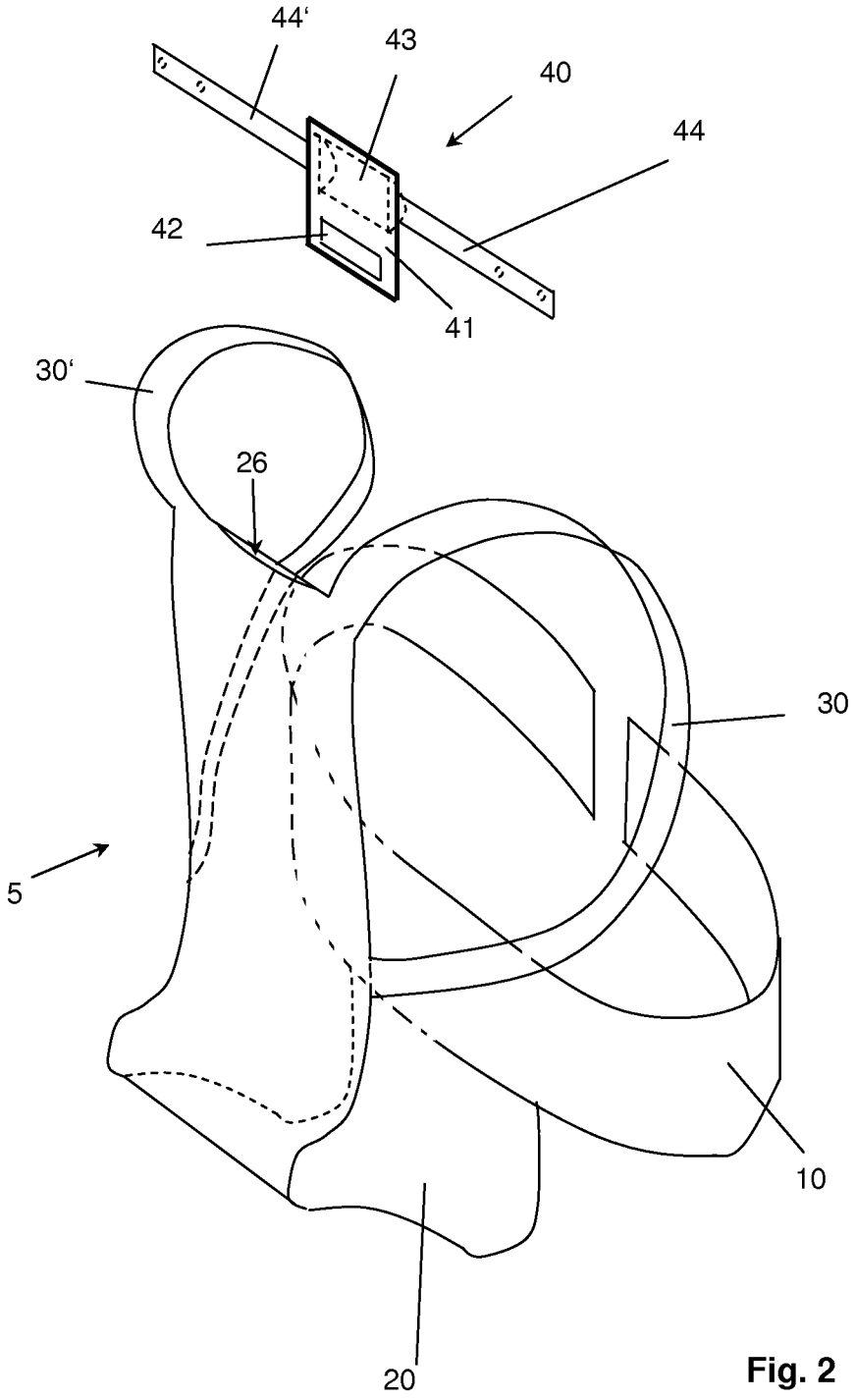
Figure 4:
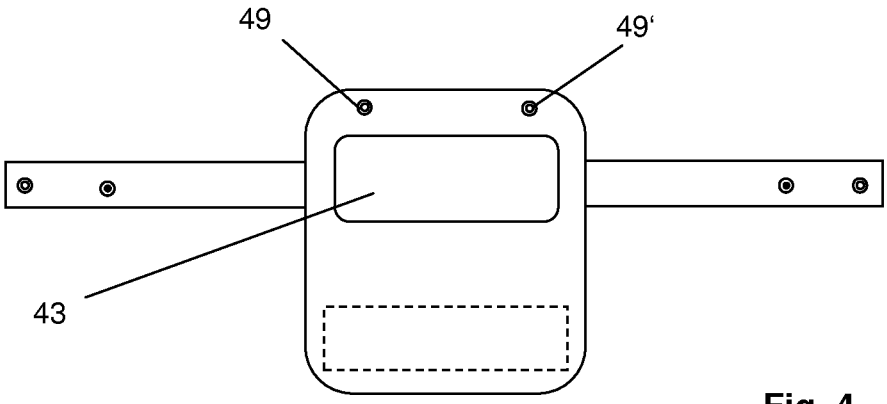

The invention is described in further detail below with the aid of an embodiment and with reference to the Figures, showing in:

FIG. 1 A small child and baby carrier, wherein the main element of this small child and baby carrier is in an unfolded or spread out state and wherein the extension element is not arranged on the main element;

FIG. 2 A perspective view of the carrier shown in FIG. 1;

FIG. 3 The detail A from FIG. 1 in a state in which the extension element is arranged on the main element;

FIG. 4 A first alternative embodiment of the extension element; and

Figure 5:
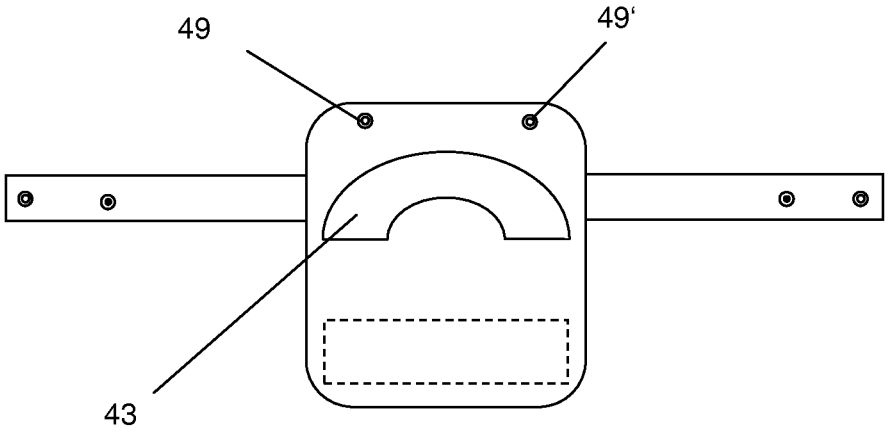

FIG. 5 A second alternative embodiment of the extension element.

FIG. 1 shows an exemplary embodiment of a small child and baby carrier according to the invention, in a folded out state, while FIG. 2 shows the carrier from FIG. 1 in a perspective view.

The small child and baby carrier consists of two elements that can be joined, namely the main element 5 and the extension element 40. The design of the main element 5 for the most part corresponds to a traditional small child and baby carrier. We first want to discuss this main element which comprises a waist strap 10 that extends from a first end 12 to a second end 14. The two ends 12, 14 can be connected to each other, for example with the aid of a plastic clasp as known from backpacks (not shown). Extending from the lower end of the waist strap 10 is a carry bag 20, the lower end 22 of which is connected to the waist strap 10. Adjoining the lower end 22 of the carry bag 20 is the bottom section 23, shown tapered in the exemplary embodiment, which is followed by the upper body section 25 that ends in the upper end region 24 of the carry bag 20. Extending from the upper end region 24 of the carry bag are two shoulder straps 30, 30' for which the ends facing away from the upper end of the carry bag are connected or can be connected to a central or lower region of the carry bag.

At least one fastening element (which may also be referred to as "at least one upper fastening element") is arranged in the upper end region 24 of the upper body section 25. According to the embodiment described, this element is formed by a hook/Velcro element 28. In principle, it is possible to arrange this fastening element on the inside (facing the carrying person when in use), on the outside or, as shown and preferred, inside a pocket 26 that extends from the upper edge toward the inside of the upper end region 24. The hook/Velcro element 28 in this case extends parallel to the plane of the end region and, for the concrete example, the hook/Velcro element 28 faces the side of the carrying person. The pocket 26 of the example shown can be embodied as a slot that is accessible only from the upper edge, or as a pocket that can be opened. Providing such a pocket has numerous advantages, in particular if the fastening element is embodied as part of a Velcro fastener and in particular as a hook/Velcro element 28. For one thing, the fastening element is thus enclosed on all sides when not in use, thereby securely preventing damage to the fastening element and/or damage caused by the fastening element. For another thing, it also results in maximum comfort for the carried child. Finally, an extremely good total stability is achieved when the extension element is installed. In the following, we want to discuss the extension element 40.

The extension element consists of a flat basic body 41 with relatively high inherent stiffness, a bolster 43 that is arranged on this basic body 41 and points away from the basic body 41, a counter fastening element—here in the form of a fluffy Velcro element 42—and two holding straps 44, 44' that extend on opposite sides outward from the sides of the basic body. These two holding straps are respectively provided with a snap 46, 46' and a counter snap 48, 48' as connecting pair. The counter fastening element in this case is arranged below the bolster 43. For the concrete example shown herein, the counter fastening element (fluffy Velcro element 42) and the bolster 43 are located on different ides of the flat basic body 41. The feature "relatively high inherent stiffness" of the basic body 41 is understood to mean, in particular, that its inherent stiffness is higher than that of the holding straps 44, 44'.

If the extension element 40 is to be used (that is the case if a somewhat bigger child is to be carried), then a lower section of the basic body 41, namely the section containing the fluffy Velcro element 42, is inserted into the pocket 26 and the fastening element (hook/Velcro element 42) and the counter fastening element (fluffy Velcro element 42) are connected form-fittingly and frictional. Each holding strap 44, 44 is then wound around the adjacent shoulder strap 30, 30' and the two parts of the connecting pair (respectively comprising a snap and a counter snap) are joined (FIG. 3). A firm-stable extension of the upper body section 25 is thus obtained.

Should the option for sun protection on the extension element 40 be desired, additional fastening elements can be provided in the region of the upper edge of the extension element, for example in the form of additional snaps or counter snaps (reference numbers 49, 49' in FIGS. 4 and 5).

FIG. 5 shows an alternative shape for the bolster 43 which is embodied sickle-shaped or U-shaped in this case, meaning it has legs on the side, thereby resulting in an improved side hold for the child's head.

For the concrete example shown, the fastening unit between the upper end region of the carry bag and the extension element is embodied as Velcro fastener, wherein this is the preferred but not required design. In particular, a connection with the aid of buttons, snaps or with a zipper could also be used. The connection pairs on the holding straps could in the same way also be embodied other than with snaps and counter snaps, wherein snaps and counter snaps are preferred.

The waist strap, carry bag and surface of the extension element advantageously consist of the flexible materials generally used for this purpose, preferably of a synthetic or natural fiber fabric.

REFERENCE NUMBER LIST

5 main element
10 waist strap
12 first end of the waist strap
14 second end of the waist strap
20 carry bag
22 lower end
23 bottom section
24 upper end region
25 upper body section.
26 pocket
28 hook/Velcro element
30, 30' shoulder strap
40 extension element
41 flat basic body
42 fluffy Velcro element
43 bolster
44, 44' holding strap
46, 46' snap
48, 48' counter snap
49, 49' additional snap or counter snap

The invention claimed is:

1. A child and baby carrier, comprising:
a waist strap;
a carry bag having a lower end, that is connected to the waist strap, an upper end region, a bottom section adjacent to the lower end and an upper body section extending upward from the bottom section, the bottom section and the upper body section extending between the lower end and the upper end region;
two shoulder straps that extend from the upper end region of the carry bag;
at least one upper fastening element provided in the upper end region of the carry bag;
an extension element, detachably arranged at the upper end region of the carry bag, between the two shoulder straps, the extension element extending from the upper body section in an upward direction when in use, said extension element including
a flat basic body,
holding straps, each of which is removably connectable to a respective shoulder strap of the two shoulder straps, extending from two upper side regions of the flat basic body,
additional fastening elements that are for removably attaching a sun protector thereto, the additional fastening elements are disposed between the holding straps at the flat basic body, and
a bolster protruding from the flat basic body; and
at least one counter fastening element arranged in a lower end region of the extension element,
wherein the at least one counter fastening element and the at least one upper fastening element jointly form a detachable connection.

2. The child and baby carrier according to claim 1, wherein the at least one upper fastening element is located inside of a pocket of the carry bag.

3. The child and baby carrier according to claim 2, wherein the at least one upper fastening element is a hook element.

4. The child and baby carrier according to claim 2, wherein a fastening device is composed of the at least one upper fastening element and the at least one counter fastening element.

5. The child and baby carrier according to claim 2, wherein a fastening device is composed of the at least one upper fastening element and the at least one counter fastening element.

6. The child and baby carrier according to claim 5, wherein the at least one upper fastening element is a hook element.

7. The child and baby carrier according to claim 1, wherein the holding straps include two holding straps provided with a pair of connecting elements.

8. The child and baby carrier according to claim 1, wherein the flat basic body of the extension element has an inherent stiffness that is higher than a stiffness of the holding straps.

9. The child and baby carrier according to claim 1, wherein the bolster has two side legs.

10. The child and baby carrier according to claim 1, wherein the additional fastening elements are in direct contact with the flat basic body.

11. The child and baby carrier according to claim 1, wherein the additional fastening elements are above the holding straps.

12. The child and baby carrier according to claim 1, wherein the additional fastening elements are in direct contact with an upper part of the flat basic body.

13. The child and baby carrier according to claim 1, wherein the bolster is curved, and only disposed at a top portion of the flat basic body such that a bottom portion of the flat basic body is free of the bolster.

14. The child and baby carrier according to claim 1, wherein the bolster is U-shaped.

15. A child and baby carrier, comprising:

a waist strap;

a carry bag including a lower end connected to the waist strap, an upper end region, a bottom section adjacent to the lower end, and an upper body section extending from the bottom section to connect the bottom section to the upper end region;

two shoulder straps that extend from the upper end region of the carry bag;

at least one upper fastening element provided in the upper end region of the carry bag;

a sun protector for providing sun protection;

an extension element, detachably arranged at the upper end region of the carry bag to be disposed between the two shoulder straps, the extension element being extendable from the upper end region in an upward direction, said extension element having a flat basic body, holding straps each of which is removably connectable to a respective shoulder strap of the two shoulder straps, the holding straps extending from two upper side regions of the flat basic body, additional fastening elements for removably attaching the sun protector, the additional fastening elements being disposed between the holding straps at an upper edge of the flat basic body, and a bolster protruding from the flat basic body; and at least one counter fastening element arranged in a lower end region of the extension element and forming a detachable connection with the at least one upper fastening element.

16. The child and baby carrier according to claim 15, wherein the additional fastening elements are in direct contact with the flat basic body.

17. The child and baby carrier according to claim 15, wherein the additional fastening elements are above the holding straps.

18. The child and baby carrier according to claim 15, wherein the additional fastening elements are in direct contact with an upper part of the flat basic body.

19. The child and baby carrier according to claim 15, wherein the bolster is curved, and only disposed at a top portion of the flat basic body such that a bottom portion of the flat basic body is free of the bolster.

20. The child and baby carrier according to claim 15, wherein the bolster is U-shaped.

* * * * *